United States Patent [19]

Shuck et al.

[11] Patent Number: 4,577,972

[45] Date of Patent: Mar. 25, 1986

[54] SPOUTED BED BLENDER APPARATUS

[75] Inventors: David L. Shuck, Golden, Colo.; Irving E. Knudsen, Murrysville, Pa.

[73] Assignee: Westinghouse Electric Corp., Pittsburgh, Pa.

[21] Appl. No.: 435,167

[22] Filed: Oct. 19, 1982

Related U.S. Application Data

[63] Continuation of Ser. No. 197,320, Oct. 15, 1980, abandoned.

[51] Int. Cl.[4] ..... B01F 13/02

[52] U.S. Cl. ..... 366/101; 366/159; 366/136

[58] Field of Search ..... 366/101, 105, 106, 102, 366/107, 173, 177, 178, 336, 341, 159, 3, 131, 134, 136, 137, 183; 34/57 R, 57 A, 102; 406/136, 137

[56] References Cited

U.S. PATENT DOCUMENTS

| | | | |
|---|---|---|---|
| 2,767,127 | 10/1956 | Guala | 366/101 X |
| 3,145,975 | 8/1964 | Towns, Jr. | 366/137 |
| 3,159,383 | 12/1964 | Van Munster . | |
| 3,219,420 | 11/1965 | Dielenberg | 366/107 |
| 3,647,188 | 3/1972 | Solt . | |
| 3,648,985 | 3/1972 | Matweecha . | |
| 3,729,175 | 4/1973 | Matweecha . | |
| 3,746,312 | 7/1973 | Pirk . | |
| 3,825,230 | 7/1974 | Frye . | |
| 3,871,626 | 3/1975 | Wohlfarth . | |
| 3,881,702 | 5/1975 | McIver . | |
| 3,887,337 | 6/1975 | Descamps . | |
| 4,172,667 | 10/1979 | Zenz | 366/107 |
| 4,185,926 | 1/1980 | Lyon | 366/101 |

*Primary Examiner*—Robert W. Jenkins
*Attorney, Agent, or Firm*—R. G. Brodahl

[57] ABSTRACT

A spouted bed blender apparatus is disclosed that is suitable for mixing and homogenizing two or more types of nuclear powders in preparation for the subsequent manufacture of nuclear fuel pellets.

5 Claims, 8 Drawing Figures

SPOUTED BED BLENDER APPARATUS

This is a continuation of application Ser. No. 197,320, filed Oct. 15, 1980, now abandoned.

BACKGROUND OF THE INVENTION

Spouted bed blending is a blending technique whereby particulate material is circulated pneumatically within a blending vessel. Typically, the material is intermixed and transported from the bottom of the vessel to an area over the top of the powder material bed within the vessel by transferring the material through a draft tube. A deflector positioned at the top of the draft tube splits the powder stream and the material settles by gravity, recombining with the powder material bed within the vessel. Pneumatic circulation produces a gentle action with low shear forces in the particulate powder material.

Nuclear fuel powder material blending requires that both a macro and micro homogeneity specification be met by the material blend. Certain nuclear oxide powders tend to form soft agglomerates which may exceed the micro homogeneity specifications for the manufacture of nuclear fuel pellets. The typical prior art processing required a ing to destroy any such soft agglomerates.

Macro homogeneity is based on a one gram sample. For a typical blending specification of 6% plutonium oxide, $PuO_2$, concentration in a uranium dioxide, $UO_2$, matrix the chi squared distribution limits for 95% of values fall within a desired limit range of 0.19% and −0.05% in relation to different enrichments, and taking the 0.19+0.05 to give 0.24% which is then divided by 2 to provide a workable form for various enrichments of a 2% relative error. Thusly, it was established that 2% of the nominal enrichment as a relative error is allowed to meet the desired macro homogeneity. Then by taking x number of samples and analyzing these samples for plutonium oxide, would give the standard deviation. The chi squared tables permit the calculation of the standard deviation at the 95% confidence levels and these are corrected for analytical error. This valve is then divided by the sample mean to give the relative error which can be compared to the 2% target value.

Micro homogeneity involves the size of the enriched domains within a fabricated fuel pellet and is determined by polishing a fuel pellet cross section and microscopically analyzing the polished surface. A typical micro homogeneity specification is that no domain of plutonium oxide having an effective diameter larger than 400 microns exists anywhere in the fuel pellet. Failure to meet this specification could result in hot spots within the pellet during operation which could cause fuel pellet failure.

There are two known types of spouted bed blenders. One utilizes an unconfined draft induced by gas jets at the bottom of the powder material bed such as disclosed by U.S. Pat. No. 3,746,312 of Pirk et al, and the other includes a draft tube or tubes through which one or more gas jets issue providing for the increased mixture of the powder material being blended.

The typical nuclear fuel pellet powder material has a particle size of 10 microns or less and tends to agglomerate due to electrostatic charge accumulation. Such agglomeration interferes with achieving the fabrication requirements for mixed oxide fuel pellets relative to macro and micro homogeneity. Because of the fineness of this powder material, a conventional fluidized bed apparatus is not suitable for blending purposes since the fluidizing gas produces channels in the fine powder material through which the gas passes resulting the stagnant zones on either sides of said channels and formation of agglomerates in the powder material.

Mechanical mixers with a rotating member inside the mixer are generally not acceptable for blending large batches of nuclear fuel powders, i.e., greater than 150 kilograms, because of the geometry constraints for criticality control throughout the nuclear fuel blending and fabricating processes.

SUMMARY OF THE INVENTION

A spouted bed blender for nuclear fuel powder materials is provided, which includes a shear producing apparatus within the blender for the purpose of breaking up and destroying any agglomerates produced in the powder material, thus reducing the requirement for any additional milling operation after blending of the powder material is completed. An additional high velocity gas jet stream is provided to increase the particle velocity of particles within the draft tube gas jet stream and for impinging the resultant accelerated particles against a stationary target or against other such particles, so as to achieve a finer degree of homogeneity within the blended powder material.

PREFERRED EMBODIMENT OF THE INVENTION

Figure 1:
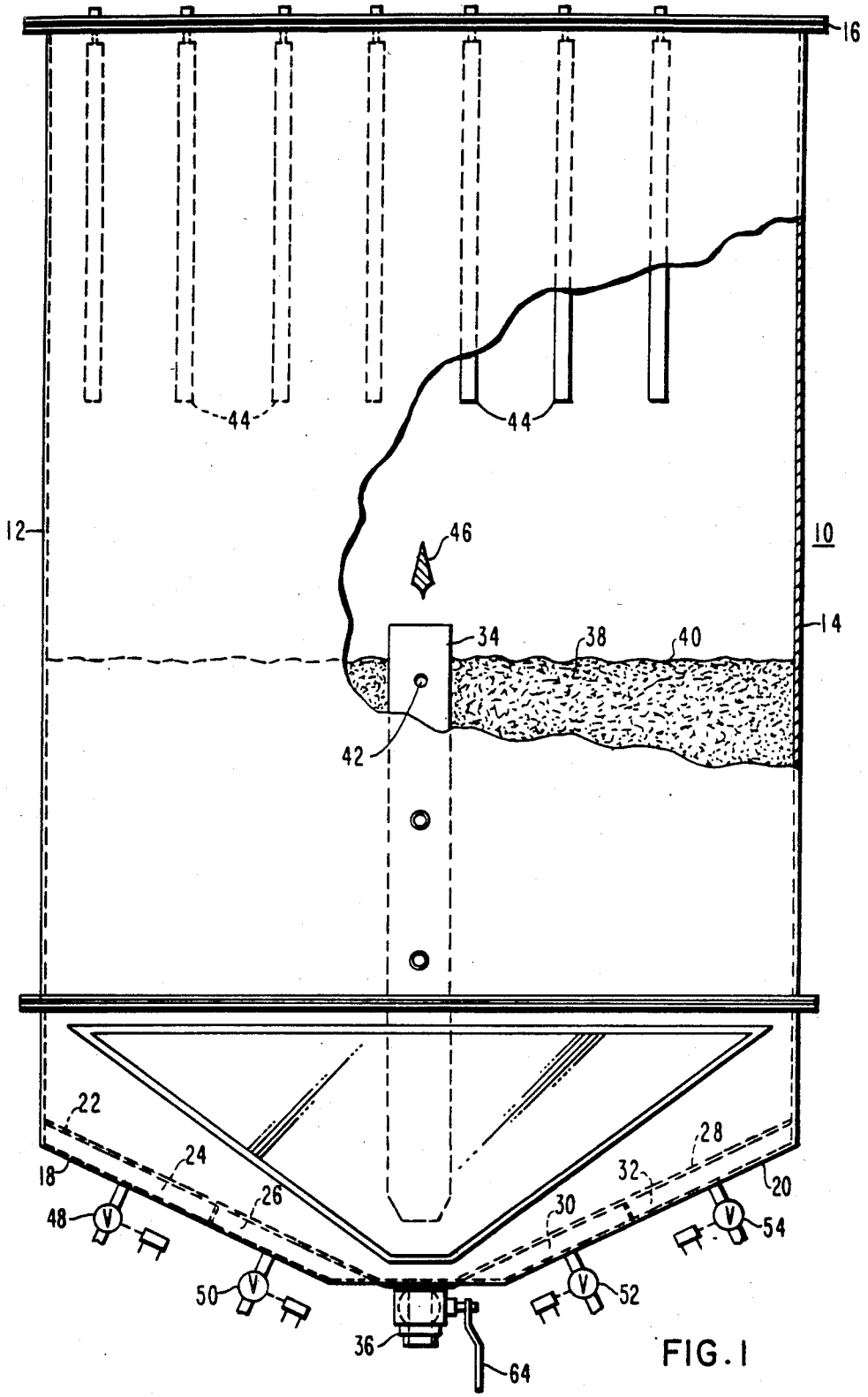
FIG. 1 is a front view of the present blender apparatus.

In FIG. 1 there is shown a vertically standing spouted bed blender apparatus 10, including a main blender body having side walls 12 and 14, a top 16 and bottom sections 18 and 20. The bottom sections 18 and 20 are shown sloped about 25 degrees above horizontal, however, some variation of this slope between 15 and 35 degrees would be suitable. The bottom section 18 includes an inner wall 22 made of porous sintered metal and divided into an outer chamber 24 and an inner chamber 26. The bottom section 20, is similar to bottom section 18, including an inner wall 28 made of porous sintered metal and including an inner chamber 30 and an outer chamber 32. A shear producing draft tube 34 is provided, with the bottom of that draft tube 34 being a predetermined distance above a gas inlet control valve 36. The powder material 38 to be blended is provided within the blender apparatus 10, up to a level 40 almost to the top of the draft tube 34. Provided within the draft tube 34 is a jet milling orifice 42 for providing a gas stream substantially perpendicular to the powder material flow up through the draft tube 34. At the top of the blender apparatus 10 there are provided a plurality of well-known filter candles 44 made of sintered metal for the purpose of removing gas from the interior of the blender apparatus 10. A physical diverter member 46 is provided above the draft tube 34 for diverting and distributing the flow of powder material back onto the top 40 of the powder bed 38.

The bottom support surfaces 22 and 28 are made of sintered stainless steel metal material made from pressed powder that is sintered to provide bonding between individual particles to provide a powder support surface through which air can be permeated but with a sufficiently high pressure drop to give a reasonably equal air distribution over the whole area of bottom support surfaces 22 and 28. The multiple chambers 24, 26, 30 and 32 are provided with pulsed gas flow that can be switched back and forth by the operation of solenoid valves 48, 50, 52 and 54, such that the inner chambers 26 and 30 are provided with a flow in the order of 1.1 standard cubic feet per minute for a period of one second and then the outer chambers 24 and 32 are provided with a gas flow in the order of 2.3 standard cubic feet per minute for a period of 3/10 of a second and these pulsing periods are successively and repeatedly applied to the inner and outer chambers.

Opposing gas jets are provided through the orifice 42 shown in FIG. 1, and a corresponding orifice on the opposite side of the draft tube 34, for breaking up agglomerates within the powder material stream that passes up through the draft tube 34 due to the momentum of the gas stream provided through control valve 36. These agglomerates are soft and held together by weak forces and repeatedly break down and reform, but they become more homogeneous after each such breakdown. The gas jets provided through the orifice 42 are in the order of one standard cubic foot per minute with an orifice size of 20 to 30 thousandths of an inch. As used herein a standard cubic foot of air refers to the mass of air occupying a volume of one cubic foot at 70° F. under one atmosphere of pressure. The gas flow through the control valve 36 can vary in the order from 19 to 25 standard cubic feet per minute.

The slab blender apparatus 10 is illustrated as substantially a rectangular vessel with an inside thickness of about 2.5 inches, and in effect a five sided vessel with the bottom sections 20 and 18 being provided at a slope in relation to the horizontal to allow powder material flow along the aerated porous wall surfaces 22 and 28, which are supplied with fluidizing gas to induce circulation of the particle material down through the bed 38 and toward the lower entrance to the draft tube 34. The gas jet, provided through the control valve 36, passes up through the draft tube 34 to cause a mixing and flow of the powder material 38 up through the draft tube 34; which material is then deflected by the diverter 46 to each side of the material bed 38 at the top of the draft tube 34. The porous sintered metal filters 44 operate to remove this gas while insuring confinement of powder material solids to the material bed 38. The powder material from the bed 38 moves downward outside of and toward the base of the draft tube 34, where it combines with material coming from each side of the blender apparatus 10 and mixes in the draft tube and then is redistributed over the top of the bed 38. The draft tube can be in the order of 2 inches by 2 inches. A thin geometry blender apparatus 10 is essential in nuclear fuel blending applications due to criticality considerations which dictate the use of geometrically safe layer thicknesses.

Figure 4A:
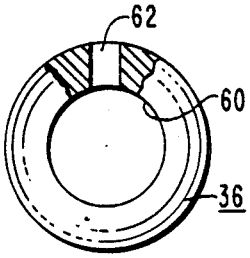
FIGS. 4A and 4B show the control valve provided for the draft tube gas input and powder material discharge operations.
Figure 4B:
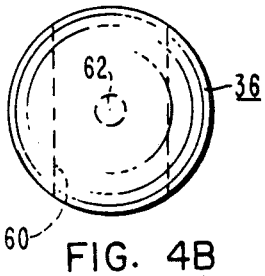

The control valve 36 can be in the form of a ball valve, such as shown in FIGS. 4A and 4B, including a 1½ inch opening bore 60 and a ⅜ inch orifice opening 62. When the ball valve 36 is moved by the control handle 64 such that the orifice opening 62 is pointing directly up toward the draft tube and aligned with the draft tube 34, high velocity gas such as air from a suitable source is introduced into the blender apparatus 10 as a jet stream into the draft tube 34 and entrains powder material from both sides of the bed 38 which slides down the porous plates 22 and 28. The powder material slides into the gas jet moving into the draft tube 34 and is entrained in the jet and passes up through the draft tube 34 whereupon it hits the diverter 46 which causes the powder material to be distributed to both the right and left sides of the bed 38, as shown in FIG. 1. Thus, the bulk of the powder material is moving down on both sides of the blender apparatus 10 into the mixing zone at the entrance of the draft tube 34. When the ball valve 36 is moved by the handle 64 such that the bore 60 is pointing directly up toward the draft tube 34, the powder material 38 can be removed from the blender apparatus 10 and a new batch of powder material can be supplied for blending in the blender apparatus 10.

Figure 2:
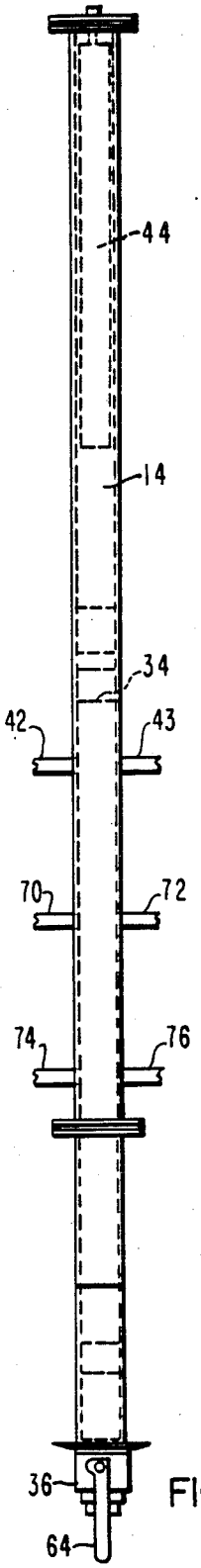
FIG. 2 is a side view of the present blender apparatus.

One embodiment of the blender apparatus 10 that was actually constructed for the mixing of uranium dioxide with plutonium dioxide powder had the dimensions indicated in FIG. 1, and was operative for mixing relatively large batches, i.e., in the order of 150 kilograms, of fine nuclear powder materials for enrichment blending of from 2 to 6% addition of plutonium dioxide with a uranium dioxide matrix. The guideline for homogeneity was a 2% relative error, which was the corrected standard deviation at the 95% confidence level divided by the sample mean blend composition. A bottom entry spout orifice 62 of ⅜ inch was provided in the discharge ball valve 36, with the draft tube 34 being aligned with the orifice 62 and with the draft tube 34 including aeration plates on the side of the tube such as shown in FIG. 2 to reduce powder material stagnant regions adjacent to the draft tube 34. When high velocity gas is supplied through the ball valve 36 this causes powder material from the bottom of the powder material bed 38 within the blender apparatus 10 to move freely into and up the draft tube 34 with the powder material solids being entrained in the expanding gas jet and carried upward. The powder material was then distributed over the top of the powder bed 38 in the blender apparatus 10 after being deflected by the diverter 46 positioned above the top of the draft tube 34. The majority of the blending and homogenization took place within the draft tube 34, with the aeration plates 22 and 28 at the bottom of the blender apparatus 10 reducing the sliding friction of the powder material and allowing it to flow toward and into the mixing zone at the entrance of the draft tube 34 and providing the desired circulation pattern of the powder material within the blender apparatus 10. The gas used to circulate the powder material up through the draft tube 34 is then filtered through the sintered metal filters 44 in the top of the blender to separate solids before the gas is exhausted to a final HEPA filter.

The desired macro homogeneity guideline of a 2% relative error at the 95% typical confidence level was achieved in the actual blender operation with a batch of 160 kilograms in a time period of between 120 and 240 minutes of blending. A mass equivalent to the total material bed was circulated through the draft tube 34 in a period of from one to two minutes duration, thus, with a typical powder material batch of 160 kilograms and a total blending time of 120 to 240 minutes, the number of equivalent bed turnovers realized was between 60 and 240 turnovers within the slab blender apparatus 10.

As compared to the operation of a V-cone mechanical blender, the slab blender apparatus 10 permitted a reduced handling of the powder material, a simplified transfer to another container and reduced the likelihood of airborne contamination. The distance provided between the gas orifice 36 and the bottom of the draft tube 34 was such that a gas jet expansion of about 15° fell within the width of the draft tube 34. The longer this spacing distance the greater the amount of powder material available for transport through the draft tube 34. The gas velocity in the draft tube 34 was maintained at about 11 feet per second to prevent plugging. The 2.5 inch inside thickness of the blender apparatus 10 was chosen based on criticality considerations so as to insure against criticality in the powder material during the blender operation.

In FIG. 2 there is shown a side view of the blender apparatus 10 from the direction of side 14 and including the control handle 64 and the draft tube 34. The illustrated outside dimension of the blender apparatus 10 is 2.7 inches. The inside dimension was 2.5 inches. The jet milling orifice 42 is shown in relation to the opposite jet milling orifice 43, and it is within the scope of the present invention if desired to provide additional opposing jet orifices such as 70 and 72 and 74 and 76 if desired.

Figure 3A:
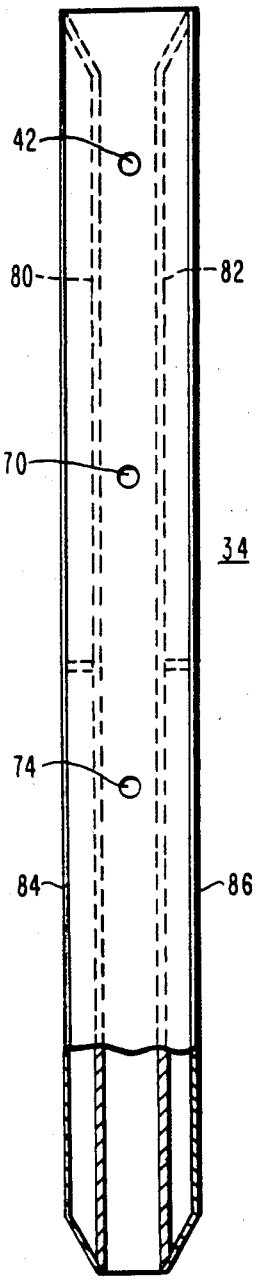
FIGS. 3A and 3B are a front view and an end view of the draft tube provided within the present blender apparatus.

In FIG. 3A there is shown a front view of the draft tube 34, including inside solid plate walls 80 and 82 and outside porous stainless steel walls 84 and 86. Gas such as air is supplied between the inside walls 80 and 82 in relation to the respective outside walls 84 and 86 to improve the flow of powder material down through the bed 38 and along the draft tube 34 within the blender apparatus 10. The jet milling orifice 42, the jet milling orifice 70 and the jet milling orifice 74 are shown in relation to the arrangement shown in FIG. 2.

Figure 3B:
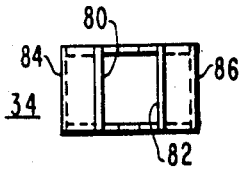

In FIG. 3B there is shown a cross-sectional end view of the draft tube 34, and showing the inside wall 82, the outside wall 86, the inside wall 80 and the outside wall 84.

Figure 5:
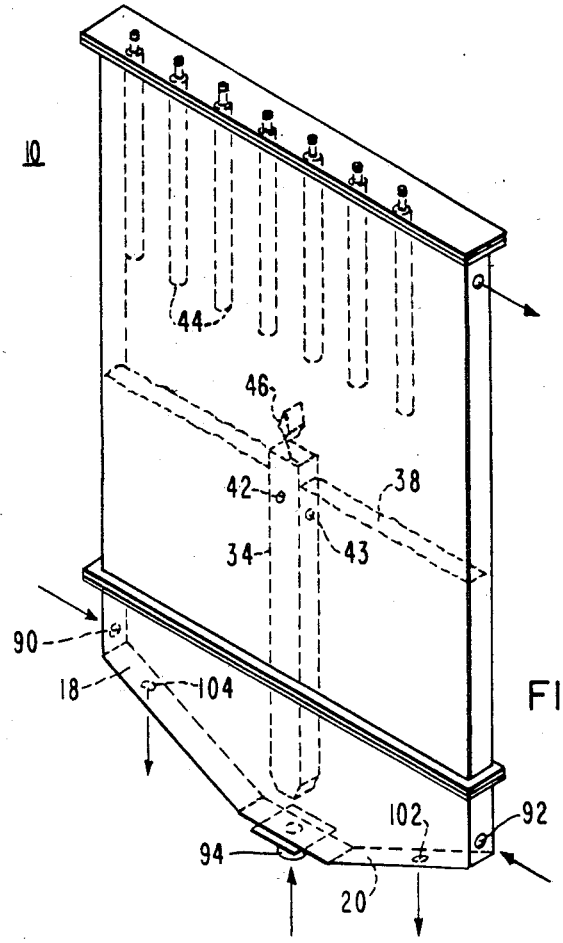
FIG. 5 shows a modification of the present blender apparatus.

In FIG. 5 there is shown a modification of the present blender apparatus 10 and including the bottom sections 18 and 20 and the draft tube 34, the filter candles 44 and the powder material diverter 46. It is within the scope of the present invention to provide the jet impingement orifices at several different locations within the blender apparatus 10. The jet orifices 42 and 43 were previously shown in FIG. 2. If desired substitute jet orifices 90 and 92 can be provided instead or in addition to those provided within the draft tube 34 and related to augment circulation and agitation of the powder bed 38.

Figure 6:
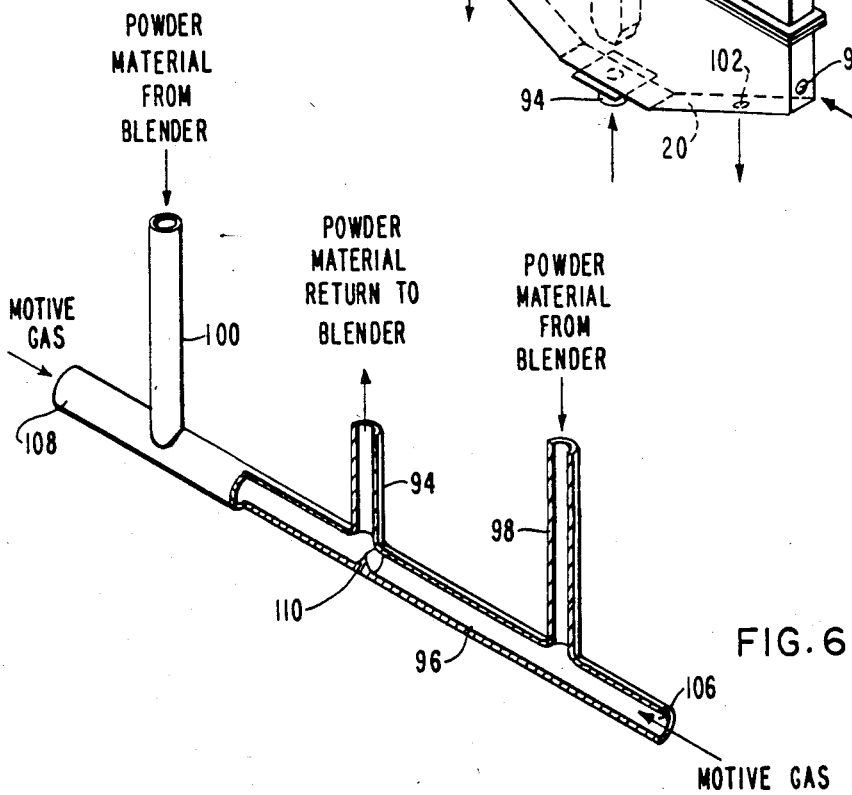
FIG. 6 shows a draft tube gas input control arrangement operative with the blender apparatus of FIG. 5.

In FIG. 6 there is shown a modified draft tube gas input control apparatus operative with the blender apparatus 10 of FIG. 5, such that the spouting gas entrance 94 shown in FIG. 5 is coupled with a gas channel 96 operative with vertical members 98 and 100 operative with openings 102 and 104 in the respective bottom sections 20 and 18 of the blender apparatus 10 shown in FIG. 5. When the motive gas is applied to inlets 106 and 108 of the channel 96 this operates with the members 98 and 100 to remove powdered material from the bed 38 through the respective members 98 and 100, which material then flows through the channel 96 and is diverted by the deflector 110 to flow up through the entrance member 94 and into the bottom of the draft tube 34 such as shown in FIG. 5. If desired, the draft tube 34 can be directly coupled with the gas entrance member 94, when using the modified gas input control apparatus shown in FIG. 6, with no spacing distance between the bottom of the draft tube 34 and the top of the entrance member 94.

The high velocity gas jets, incorporated into the spouted bed blender apparatus designs shown in FIGS. 1 and 5, are operative to circulate the powder material within the blender apparatus 10. The jets 42 and 43 are designed to provide directional flow and may be of a well known venturi design to increase gas velocity, in a direction substantially perpendicular to the movement direction of the powder material passing upward through the draft tube 34. The orientation of the jet orifices 42 and 43 is selected to prevent dead zones within the powder material passing through the draft tube 34. The opposing jet gas streams operate to produce agglomerate attrition by means of either particle-with-particle or particle-with-target 46 collisions, such that the powder material particles entrained by the high velocity gas stream and moving upward within the draft tube 34 are accelerated to a sufficiently high velocity such that said collisions result in shear forces of sufficient magnitude to overcome the attractive forces holding the powder material agglomerates together and the desired size reduction occurs.

We claim:

1. In a blender apparatus for homogenizing at least two nuclear fuel powder material, the combination of container means for holding a bed of said nuclear fuel powder materials, first shear producing means including a draft tube positioned vertically within said container means and including a gas stream for transporting powder material through said tube from the bottom of said bed in a first direction toward the top of said bed, diverter means positioned within said container means and located in relation to the top of said draft tube for diverting the resultant powder and gas stream produced by said first shear producing means onto the top of said bed, and second shear producing means positioned within the container means and operated relative to said first shear producing means for increasing the velocity of some portion of the powder material within said draft tube in a second direction different than said first direction for the purpose of breaking up agglomerates of powder material within said draft tube thereby improving both the rate and extent of powder material homogeneity.

2. The blender apparatus of claim 1, with said first shear producing means including said draft tube through which the gas stream flows and extending in said first direction from the bottom of said bed to above the top of said bed.

3. The blender apparatus of claim 1, with the second shear producing means including a second gas stream for moving the powder material in said second direction.

4. The blender apparatus of claim 1, with said second shear producing means being coupled with said first shear producing means for moving the powder in a second direction substantially perpendicular to said first direction.

5. The blender apparatus of claim 1, with the second shear producing means including opposing gas jets provided in the first shear producing means to produce agglomerate attrition of said powder materials transported in said first direction through the first shear producing means.

* * * * *